US007204380B2

(12) United States Patent
Webb et al.

(10) Patent No.: US 7,204,380 B2
(45) Date of Patent: Apr. 17, 2007

(54) DRINKING VESSEL

(75) Inventors: Ian Alexander Webb, London (GB); Richard Wearmouth, Durham (GB); Richard Hudson, Hilton (GB)

(73) Assignee: Jackel International Limited (GB)

( * ) Notice: Subject to any disclaimer, the term of this patent is extended or adjusted under 35 U.S.C. 154(b) by 204 days.

(21) Appl. No.: 10/380,338

(22) PCT Filed: Jul. 25, 2001

(86) PCT No.: PCT/GB01/03340

§ 371 (c)(1),
(2), (4) Date: Aug. 25, 2003

(87) PCT Pub. No.: WO02/22073

PCT Pub. Date: Mar. 21, 2002

(65) Prior Publication Data

US 2004/0035815 A1 Feb. 26, 2004

(30) Foreign Application Priority Data

Sep. 12, 2000 (GB) ..... 0022345.3

(51) Int. Cl.
*A61J 9/00* (2006.01)
*A61J 11/00* (2006.01)
*A47G 19/22* (2006.01)

(52) U.S. Cl. ..... 215/11.4; 215/11.1; 215/11.6; 220/714; 137/843

(58) Field of Classification Search ..... 215/11.1, 215/11.4, 11.5; 220/714; 401/206; 137/843
See application file for complete search history.

(56) References Cited

U.S. PATENT DOCUMENTS

| | | | | |
|---|---|---|---|---|
| 4,138 | A | | 8/1845 | Pratt |
| 1,825,553 | A | | 9/1931 | Smith |
| 2,174,361 | A | | 9/1939 | Condon |
| 2,210,206 | A | * | 8/1940 | Fisher ..... 401/206 |
| 2,223,179 | A | | 11/1940 | Lougheed |
| 2,372,281 | A | | 3/1945 | Jordan |
| 2,442,656 | A | * | 6/1948 | Less ..... 215/11.4 |
| 2,534,614 | A | | 12/1950 | Michael |
| 2,569,139 | A | | 9/1951 | Abelson |
| 2,584,359 | A | | 2/1952 | Miles ..... 128/252 |
| 2,597,483 | A | * | 5/1952 | Head, Sr. ..... 137/533.29 |
| 2,608,841 | A | | 9/1952 | Rice |
| 2,672,124 | A | * | 3/1954 | McCrary ..... 119/71 |
| 2,803,251 | A | * | 8/1957 | White ..... 215/11.4 |
| 2,816,548 | A | | 12/1957 | Tupper |
| 2,989,961 | A | | 6/1961 | Blanchett |
| 3,139,064 | A | | 6/1964 | Harle |
| 3,141,580 | A | | 7/1964 | Rogers ..... 222/213 |
| 3,203,026 | A | * | 8/1965 | Schwartzman ..... 401/206 |
| 3,244,332 | A | | 4/1966 | Rogers ..... 222/213 |

(Continued)

FOREIGN PATENT DOCUMENTS

DE 272349 3/1914

(Continued)

*Primary Examiner*—Sue A. Weaver
(74) *Attorney, Agent, or Firm*—Osha Liang LLP

(57) ABSTRACT

An infant cup includes a cup body 12, a cover 16, a flexible mouthpiece 24 and a valve element 26. The valve element 26 includes a sealing face 70 which closes an orifice 44 in the mouthpiece in a relaxed position. The valve element includes an angled face cooperating with an internal angled face of the mouthpiece such that when pressure is applied the valve element moves downwardly, opening the mouthpiece orifice 44. The valve element is resiliently biased upwards such that when relaxed it springs back to close the mouthpiece orifice 44 once again, and is biased upwards in the closed position.

18 Claims, 13 Drawing Sheets

U.S. PATENT DOCUMENTS 3,372,832 A 3/1968 Yeater et al.
3,424,157 A 1/1969 Di Paolo
3,635,380 A 1/1972 Fitzgerald
3,650,271 A 3/1972 Pelli
3,656,660 A 4/1972 Mueller ..... 222/94
3,704,803 A 12/1972 Ponder
3,722,728 A 3/1973 Yazaki
3,732,999 A 5/1973 Rounkles
3,905,512 A 9/1975 Albert et al.
3,964,631 A 6/1976 Albert
4,135,513 A 1/1979 Arisland
4,138,033 A 2/1979 Payne et al.
4,184,604 A 1/1980 Amberg et al.
4,190,174 A 2/1980 Haimowitz
4,204,604 A 5/1980 Morin et al.
4,235,343 A 11/1980 Thompson
4,238,045 A 12/1980 D'Andria
4,245,752 A 1/1981 Prueher
4,249,392 A 2/1981 Hotta
4,301,934 A 11/1981 Forestal
4,303,170 A 12/1981 Panicci
4,339,046 A 7/1982 Coen
4,361,249 A 11/1982 Tuneski et al.
4,412,623 A * 11/1983 Schmidt ..... 215/11.1
4,441,624 A 4/1984 Sokolowski
4,463,859 A 8/1984 Greene
4,582,214 A 4/1986 Dart et al.
4,592,478 A 6/1986 Laconis
4,623,069 A 11/1986 White
4,640,424 A 2/1987 White
4,756,440 A 7/1988 Gartner
4,782,975 A 11/1988 Coy
4,796,774 A 1/1989 Nabinger
4,836,404 A 6/1989 Coy
4,921,112 A 5/1990 Juhlin et al.
4,946,062 A 8/1990 Coy
4,953,737 A 9/1990 Meyers
4,966,580 A 10/1990 Turner et al.
4,969,564 A 11/1990 Cohen et al.
4,993,568 A 2/1991 Morifuji et al.
D316,652 S 5/1991 Hunter
5,035,340 A 7/1991 Timmons
5,040,756 A 8/1991 Via Cava
5,050,758 A 9/1991 Freeman et al.
5,072,842 A 12/1991 White
5,079,013 A 1/1992 Belanger
5,101,991 A 4/1992 Morifuji et al.
5,186,347 A 2/1993 Freeman et al. ..... 220/254
5,271,531 A 12/1993 Rohr et al.
5,542,670 A 8/1996 Morano
5,601,212 A * 2/1997 Lee ..... 222/205
5,607,073 A * 3/1997 Forrer ..... 215/11.4
5,747,083 A * 5/1998 Raymond et al. ..... 426/117
5,893,472 A * 4/1999 Forrer ..... 215/11.4
5,899,624 A * 5/1999 Thompson ..... 401/206
6,003,698 A * 12/1999 Morano ..... 215/11.1
6,047,849 A * 4/2000 Schwegman et al. ..... 220/737
6,062,419 A * 5/2000 Kruger et al. ..... 220/711
6,343,704 B1 * 2/2002 Prentiss ..... 215/11.1
6,575,118 B1 * 6/2003 McKee ..... 119/71

FOREIGN PATENT DOCUMENTS

DE 275456 6/1914
DE 3118976 A1 12/1982
EP 0266067 A1 * 5/1988
EP 0326743 A3 8/1989
EP 0382631 A1 8/1990
EP 0384394 B1 8/1990
EP 0555623 A1 8/1993
EP 0643922 B1 10/2000
GB 220075 8/1924
GB 409919 5/1934
GB 422348 1/1935
GB 460274 1/1937
GB 616957 1/1949
GB 697201 9/1953
GB 854163 11/1960
GB 854186 11/1960
GB 967953 8/1964
GB 1253398 11/1971
GB 1360893 7/1974
GB 1447626 8/1976
GB 1470641 4/1977
GB 2015350 A 9/1979
GB 2131301 A 6/1984
GB 2158049 A 11/1985
GB 2169210 A 7/1986
GB 2170791 A 8/1986
GB 2187722 A 9/1987
GB 2266045 A 10/1993
GB 2304545 A 3/1997
GB 2311061 A 9/1997
GB 2318783 A 5/1998
GB 2 333 770 A 8/1999
WO WO-93/19718 10/1993
WO WO-96/15978 5/1996
WO WO96/36826 * 11/1996
WO WO 99 47029 9/1999
WO WO 9956532 * 11/1999
WO WO 00 48491 8/2000
WO WO 00/48491 8/2000

* cited by examiner

DRINKING VESSEL

BACKGROUND OF THE INVENTION

The invention relates to a drinking vessel, for example a vessel such as a children's drinking vessel and preferably an infant drinking vessel.

A range of infant cups are known, for example of the type generally termed trainer cups, including a cup-like body often including handles for ease of use by a infant, a cover and a drinking spout provided on the cover. The cup is easier to handle and allows the infant to drink from the cup with less risk of spillage.

Various improvements to infant cups are known. In one example a trainer cup includes a slit valve membrane fixed at the tip of a rigid spout, which allows liquid to flow when the infant sucks but closes otherwise. As a result the cup is largely spill-proof under normal conditions.

Problems exist with the known arrangement, however. The moulding and fitting of the membranes may be a complex and costly operation, residue may be trapped where the membrane and spout meet, and because of the typically small orifice at the spout and the fragility of the membrane it may be difficult to clean. In addition, the child is often required to suck very hard to open slit valve membranes of this type which can be tiring and offputting for the child. Because the slit valves are very fragile they can be easily damaged, a particular risk in view of the use of the cup by a child, and the likelihood that a child will be left unattended with it because of its spillproof nature.

In addition, individual components within the system cannot be varied, as a result of which it is necessary to purchase a new product if any component fails or if the infant needs to move onto a new stage—for example if a stiffer valve action is required.

Yet further, as liquid is removed from the known cups, a negative pressure may develop in the cup which may make further drinking yet harder and removal of the lid equally difficult. It is difficult to open the valve manually to overcome this problem without damaging it.

A particular problem with valves of the known type arises when fruit juices are drunk from the vessel—in this case the fibres can clog the slit and prevent it from sealing properly, which can give rise to leakage.

Yet a further problem arises with arrangements such as this because of the rigid spout. In some instances biting or sucking on a hard spout can lead to tooth damage for the infant during the important teething stage, especially for infants up to 9 months of age. As the known systems allow liquid to flow only under pure suction, "grazing" is encouraged whereby the infant sucks continually, as can be the case with more standard feeding bottles. This can lead to the infant's teeth being bathed for long periods in the liquid in the cup, which will often be a sweet drink, and again can give rise to tooth damage.

Various other valved designs are known for infant drinking cups. For example PCT/GB00/00479, commonly assigned herewith, relates to an arrangement in which a flexible spout having an orifice cooperates with a pin or plug closing the orifice in an unflexed state such that when the spout is stretched away from the pin liquid can flow. It is desired to improve yet further the long term performance of such an assembly and further enhance the seal between the parts taking into account creep of materials with age whilst not prejudicing ease of drinking.

According to another known system described in GB 2 333 770 an infant cup includes a valve at the base of the mouthpiece including a flexible annular diaphragm valve member. When suction is applied the inner diameter of the diaphragm flexes away from a seat allowing fluid flow. As a negative pressure builds up in the vessel the outer diameter of the diaphragm flexes away from a "breather hole" to allow air in and equalise the pressure in the vessel.

Problems with systems with small parts include difficulty in cleaning and the possibility of a choking hazard for infants.

Other known arrangements include U.S. Pat. No. 5,186,347 and WO 99/47029, which suffer from problems of the type identified above.

SUMMARY OF THE INVENTION

According to the invention there is provided a drinking vessel comprising a vessel body, a cover including a flexible mouthpiece defining a flow passage from the vessel body and a valve element moveable relative to the mouthpiece in flow passage opening and closing directions, in which the mouthpiece and valve element have cooperating formations arranged such that, in a flexed condition when a force is applied to the mouthpiece, the valve element moves in the flow passage opening direction, and in which the valve element is biased in the closing direction in a relaxed condition. As a result the vessel promotes a healthy drinking action, especially for infants. Because the valve element is movable and biased towards the closing direction, when suction alone is applied liquid will not flow. Instead it is necessary to apply a force to the mouthpiece which then opens the valve. As a result the valve opens under a pursing, biting or stripping action which has been shown to be highly beneficial to the development of infants. The flexibility of the mouthpiece also reduces the risk of damage to the infant's teeth. Yet further, the valve element can be self-venting because the valve element is mounted movable relative to the mouthpiece.

Preferably the mouthpiece has a top, including a drinking orifice, and sides, the mouthpiece being arranged such that, to obtain a flexed condition, a force is applied to the sides of the mouthpiece. The use of a stripping action is yet further enhanced, therefore. The valve element preferably closes the drinking orifice in the relaxed condition so that all liquid can drain back to the vessel body, but alternatively the valve element may close an aperture spaced from the drinking orifice in the relaxed condition.

The valve element preferably slides relative to the mouthpiece in the flow passage opening and closing directions, providing a significant range of motion and control of the motion of the valve element relative to the mouthpiece. The mouthpiece and valve elements are preferably individual, separable components, allowing ease of cleaning and assembly, and optimisation of the material and structure of each component. The cooperating formations on the mouthpiece and valve element preferably comprise mating surfaces in a taper fit. A simple and effective valve moving system is thus provided. Alternatively the cooperating formations may comprise a stepped portion on one of the valve element and mouthpiece and a resilient limb on the other of the valve element and mouthpiece.

The valve element preferably includes a mounting portion and a valve portion and the valve element is biased in the closing direction by a resilient web connecting the mounting portion and the valve portion. A simple and easy to clean system is thus provided. In addition the valve element can be sized and shaped so as not to constitute a choking hazard.

Alternatively the valve element may include a valve portion and a resilient portion biasing the valve portion in the closing direction. Preferably the resilient web or portion is of lesser resilience than the flexible mouthpiece, as a result of which the non-suction only operation and self-venting of the valve element is further improved.

The mouthpiece may include a drinking orifice and the valve element may close the drinking orifice in the relaxed condition and the mouthpiece and valve element may have cooperating taper surfaces in the vicinity of the drinking orifice allowing the valve element to be guided in to position to close the drinking orifice.

Preferably the mouthpiece includes a base mounted at the cover, the valve element is provided within the mouthpiece and the cooperating formations are provided in the vicinity of the mouthpiece base. As a result force applied anywhere on the mouthpiece will move the valve element in the desired manner.

According to the invention there is further provided a valve element for a drinking vessel including a mounting portion and a valve portion connected by a web defining flow apertures, in which the valve portion is resiliently biased away from the mounting portion by the web. In addition to the various advantages identified above, the element can be physically large whilst working efficiently, reducing any choking risks.

The valve element is preferably formed of flexible resilient material and hence does not damage the user's teeth. The valve portion may include a valve face and a tapered drive face.

BRIEF DESCRIPTION OF THE DRAWINGS

Embodiments of the invention will now be described, by way of example, with reference to the drawings, of which.

DESCRIPTION OF THE PREFERRED EMBODIMENTS

Figure 1:
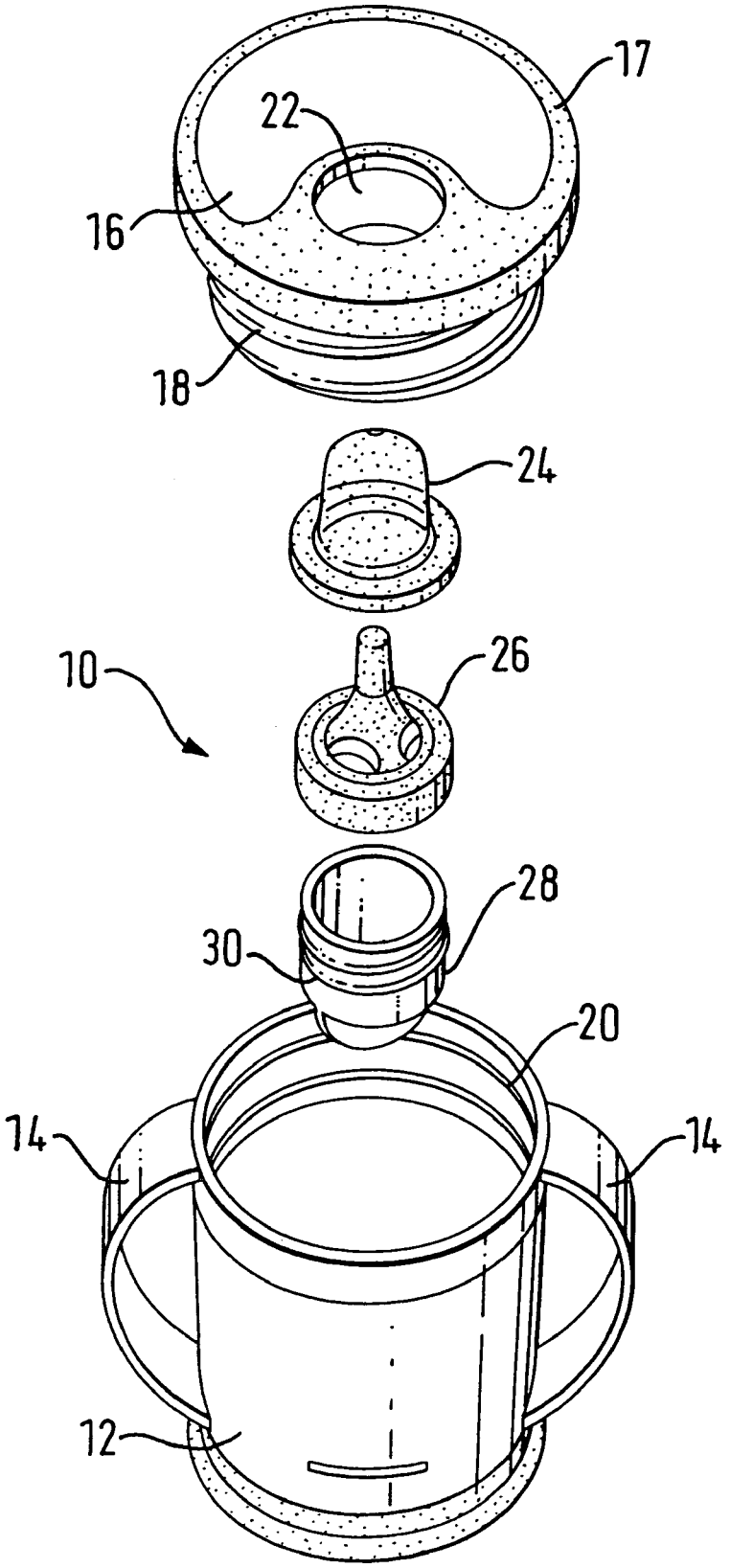
FIG. 1 shows the basic components of the drinking vessel according to the present invention.

Referring to FIG. 1 the basic components of an infant cup according to one embodiment of the present invention are shown. It will be noted that the invention is not limited to the specific construction shown. The infant cup is designated generally 10 and includes a cup body 12 of generally circular cross-section having opposed handles 14 allowing the infant to grip the cup firmly. Alternatively beaker-type vessel without handles can be used.

The cup further includes a cover 16 having a threaded skirt 18 allowing the cover 16 to be screwed into a cooperating screw thread 20 in the cup body 12. The cup body 12 and cover 16 are preferably made of polypropylene although any other suitable material can be used. Alternatively the cup body can be moulded in polypropylene and a thermoplastic elastomer (TPE) to provide a soft to the touch/easy grip feature. The TPE element in its embodiment can extend to the underside of the base to introduce a non-slip feature when the cup is placed on a surface. Another further preferred version is a cup body made of an appropriate heat sensor material which changes colour at a specified temperature. Appropriate materials will be well known to the skilled person. The base of the cup may be slightly upwardly domed. The height of the dome is selected such that when liquid is poured up to the top of the dome this represents 10% elasticity of the cup. As a result a simple dilution level indicator is provided.

The cover 16 includes a generally oval orifice 22 arranged to receive the spout or mouthpiece 24 from the underside. The cover 16 may include raised portions (not shown) to provide purchase for the user to unscrew the cover 16 more easily. The positioning of any such formations must of course be selected so as not to impede the use of the cup by the infant in any way. The outer shape of the mouthpiece 24 is generally oval or elliptical in cross-section in a horizontal plane and can follow the conventional shape of infant cup mouthpieces. However, as discussed in more detail below, the mouthpiece is formed of a flexible, resilient material for example a resilient flexible elastomer material such as silicon rubber.

The mouthpiece 24 receives a valve element 26. The valve element is also made of a resilient flexible material for example a resilient flexible elastomer material such as polyester based thermoplastic elastomer. The mouthpiece 24 and valve element 26 are retained on the cover 16 in the embodiment shown by a retaining element 28 having a screw thread 30 allowing it to be screwed into place on a cooperating formation (not shown) on the underside of the cover 16 holding the mouthpiece 24 and valve element 26 firmly in place relative to the cover 16 and one another. The mouthpiece 24 is positively located and correctly positioned by virtue of the elliptical orifice 22 in the cover 16. The thread 18 on the cover 16 and the cooperating thread 20 on the cup body 12 are configured to ensure that the mouthpiece is positioned optimally relative to the handles of the cup for infant use when the cover 16 is screwed into position.

FIGS. 2 to 5 and 12 show in more detail the interaction between the mouthpiece 24 and the valve element 26. As can be seen in FIGS. 2*a* and 2*c* the mouthpiece includes an upper mouthpiece portion 40 and, at its lower end, an annular flange 42. The flange 42 is arranged for securing the mouthpiece 24 relative to the cover and engaging against the valve element 26 and can be of any appropriate nature or omitted altogether in other embodiments. The mouthpiece may be formed of transparent or semi-transparent material such that operation of the valve element 26 is visible to the user. Viewed from above the mouthpiece is generally elliptical in shape and, for ease of reference below, can be viewed as having two "long walls" visible in front cross-section and two "short walls" visible in side cross-section terminating in a curved top.

The mouthpiece includes a drink orifice 44 at its top of generally conventional type. This can be further enhanced by introducing a generally tapered upper inner face 46 of the mouthpiece portion assists in guiding the valve element 26 to close the orifice 44 as discussed in more detail below. The tapering surface 46 further ensures a good seal with the valve element 26 as discussed in more detail below.

Figure 2A:
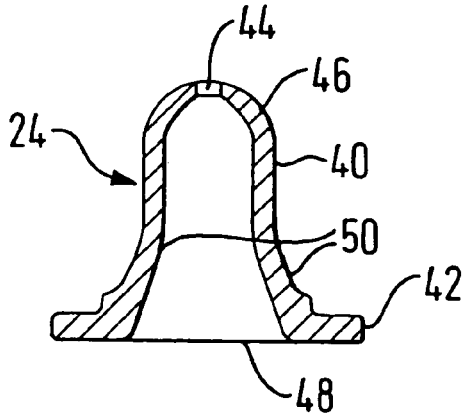
FIG. 2*a* shows a cross-sectional view of the mouthpiece forming part of the present invention.
Figure 2C:
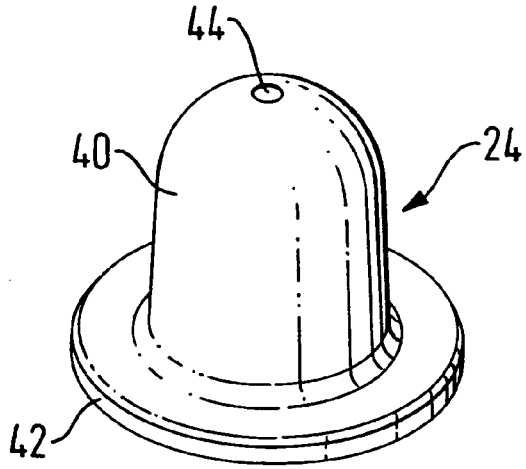
FIG. 2*c* is a perspective view of the mouthpiece of FIG. 2*a;*
Figure 3A:
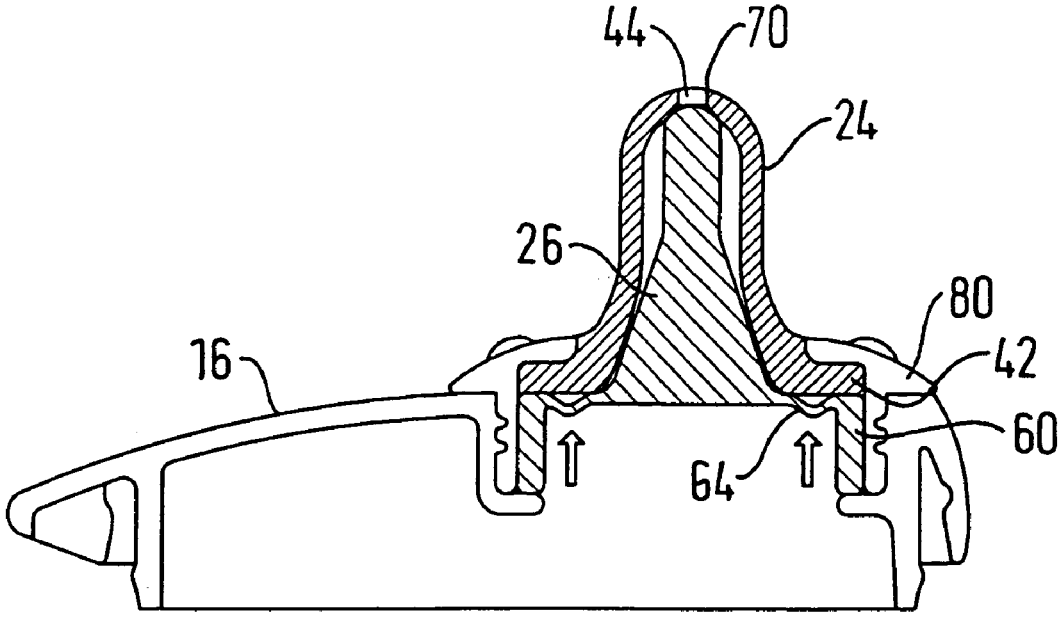
FIG. 3*a* is a side cross-sectional view of the valve in a closed position.

The base of the mouthpiece 48 comprises an opening to receive the valve element 26. As can be seen in FIGS. 2*a* and 3*a*, the mouthpiece includes lower inner wall surfaces 50 that are angled or taper generally inwardly from the base to very roughly a third of the height of the mouthpiece. For reasons discussed in more detail below, the tapered surfaces 50 are only required on the two longer walls of the mouthpiece 24 and are not provided on the short walls as can be seen from the front cross-section shown in FIG. 3*b*.

Figure 2B:
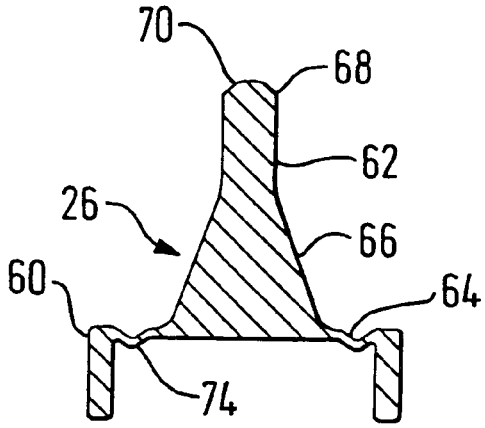
FIG. 2*b* is a cross-sectional view of the valve element forming part of the present invention.
Figure 2D:
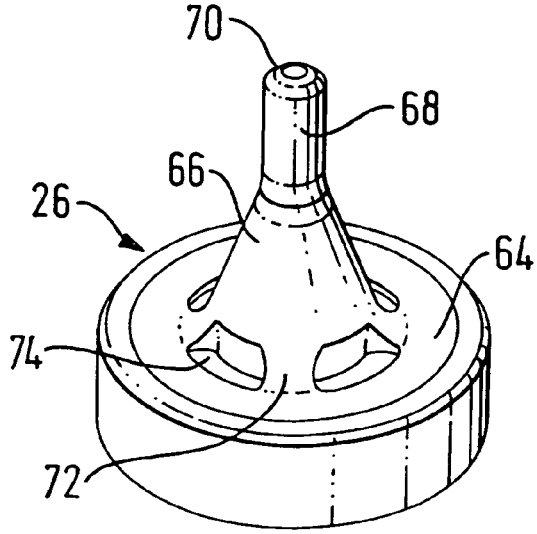
FIG. 2*d* is a perspective view of the valve element of FIG. 2*b;*

Referring now to FIGS. 2*b* and 2*d* the valve element includes a mounting portion 60 which is generally cylindrically annular shape, a valve portion 62 centred on the mounting portion 60 and projecting upwardly from it, and a web portion 64 joining the two. The various portions are preferably formed integrally from an appropriate semi-rigid material such as polyester elastomer and can be coloured so as to be easily viewed within the mouthpiece 24. The valve portion 62 has generally circular symmetry and includes a lower frusto-conical portion 66 and an upper cylindrical portion 68. At the top of the upper cylindrical portion 68 there is provided a sealing face 70 arranged to engage and close the orifice 44 in the mouthpiece 24. The sealing face 70 preferably includes a chamfered outer diameter allowing ease of location against the orifice 44 in cooperation with the tapered mouthpiece face 46 and an efficient seal.

The web portion 64 comprises, for example, a series of equi-angularly positioned limbs 72, for example four such limbs, separated by flow holes 74. The limbs 72 are of reduced thickness and may in addition be kinked as shown in FIG. 2*b*. The valve portion 62 is flexibly mounted to the mounting portion and is urged generally upwardly by the web portion 64.

The manner in which the mouthpiece 24 and valve element 26 engage and interact is best seen with reference to FIGS. 3 to 5. The valve element 26 is inserted into the open face 48 of the mouthpiece 24 and both parts are screwed onto a cover 16 by a collar 80 such that the flange 42 of the mouthpiece abuts against and forms a seal with the upper annular face of the cylindrical mounting portion 60 on the valve element 26. The circular symmetry of the mouthpiece flange 42 and valve element 26 ensure that the valve element 26 can be inserted into the mouthpiece at any orientation about its axis of symmetry. The valve element is of suitable height that the sealing surface 70 positively engages against the orifice 44 in the mouthpiece and is biased against it under the influence of web portion 64. As a result a strong and positive seal is formed. Even if there is creep or other degradation of the materials over time, because the sealing face is resiliently biased towards the orifice 44, a good seal will be maintained.

Figure 3B:
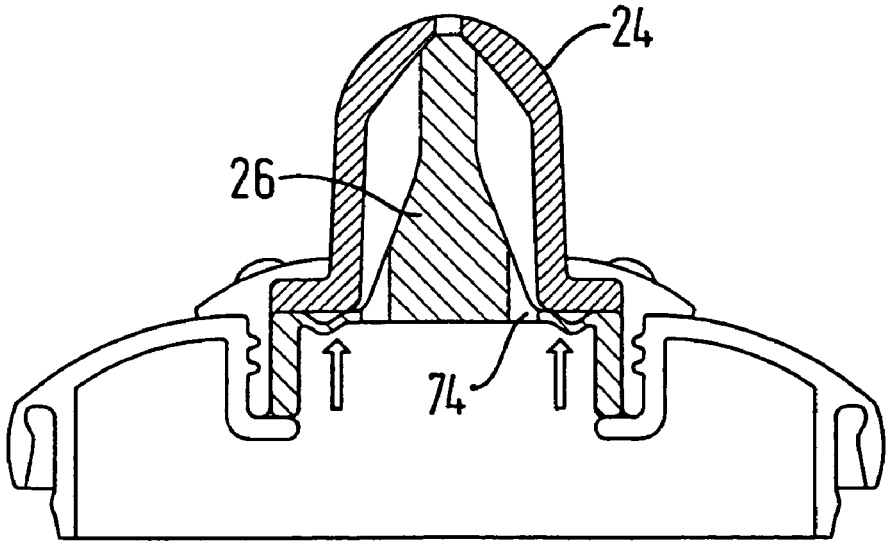
FIG. 3*b* is a front cross-sectional view of the valve in a closed position.

Because of the engagement of the chamfered portion of sealing surface 70 on the valve element 26 and the tapered portion 46 on the inner top surface of the mouthpiece 24, the valve element is guided into place to seal the orifice 44 in the mouthpiece 24 in the closed, unflexed configuration shown in FIGS. 3*a* and 3*b*. In this position liquid cannot flow out of the mouthpiece because the only outlet, orifice 44, is closed by the valve element 26.

In addition, as can be seen in the side cross-section view shown in FIG. 3*a*, the conical lower portion 66 of the valve element matches the taper of the lower inner face 50 of the mouthpiece. However these faces do not mate around the entirety of the valve element because of the generally elliptical shape of the mouthpiece. For example as can be seen in FIG. 3*b*, there is clearance between the valve element and the narrow walls of the mouthpiece allowing liquid to flow through opening 74 in the web 64 of the valve element. This can also be seen in FIG. 12, referring to the orthogonal x, y, z axes shown. In the x direction the tapering surfaces mate but in the y direction a gap can clearly be seen allowing flow via opening 74.

Figure 4A:
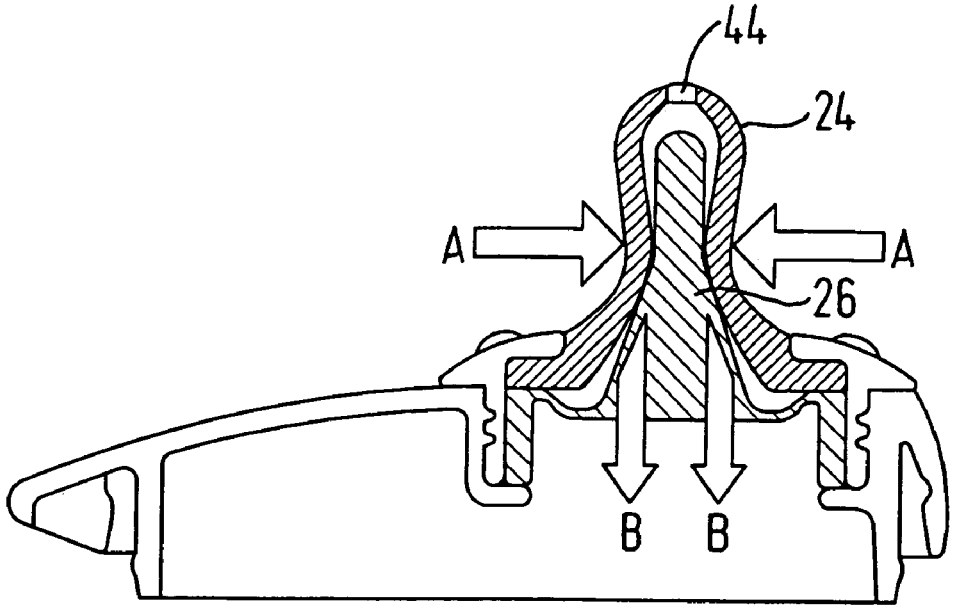
FIG. 4*a* is a side cross-sectional view of the valve in an open position.
Figure 4B:
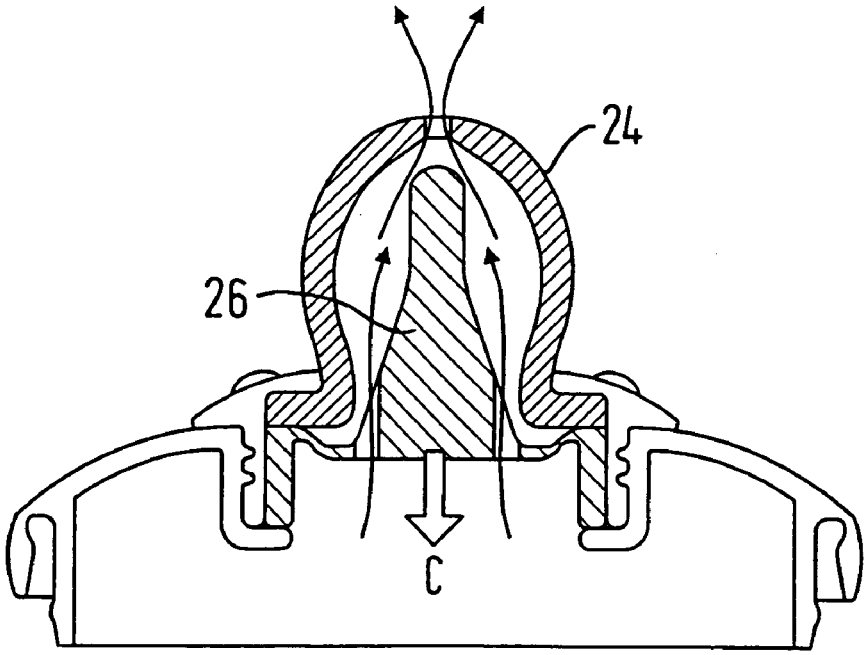
FIG. 4*b* is a front cross-sectional view of the valve in an open position.

FIGS. 4*a* and 4*b* show operation of the system to open the valve and allow fluid flow. As a sideways pressure (denoted by arrows A) is exerted on the long walls of the mouthpiece 24 the inner tapered face 50 of the mouthpiece will cooperate with the conical face 66 of the valve element to push the valve element generally downwards (as denoted by arrows B). The orifice 44 is thus opened and, as can be seen in FIG. 4*b*, liquid flows through holes 74 in the valve element and out of orifice 44. When the force A is removed the valve element 26 will spring back up to the position shown in FIG. 3*a* under the influence of web portion 64. Because the cooperating formation are at the base of the mouthpiece, whenever pressure is exerted on the mouthpiece the valve element will open. In addition, because of the taper fit movement of the valve element is limited in the valve closing direction.

A particular advantage of the configuration according to the present invention is that it encourages a natural drinking action especially in younger infants. Because the valve element is sprung upwardly, if suction alone is applied to the mouthpiece then the valve element will lift with the mouthpiece such that the orifice remains closed and liquid does not flow. In order to open the valve lateral pressure on the mouthpiece by the infant's teeth or gums is required, mimicking the "stripping action" required by infants in breast feeding in which the infant squeezes the mouthpiece by tongue, tooth or gum manipulation applying a lateral force to the base of the mouthpiece and transferring it to the top in a "stripping" action. It is well established that this stripping action is beneficial to the infant's dental development and that the transition to a pure sucking action too early can be detrimental. In addition this stripping action which is peristaltic in nature provides a discontinuous flow of liquid which can reduce caries. In addition, because the mouthpiece is of flexible material and, in the preferred embodiment, the valve element is also formed of no more than semi-rigid material, physical damage to the infant's teeth is reduced or avoided. The sensitivity of the valve coupled with the need for a stripping action which is effectively imposed on the infant, therefore gives rise to a range of advantages over known systems.

Because the degree to which the orifice is opened is dependent on the distance through which the valve member travels, a pressure-responsive valve is provided such that the user can control the flow rates by varying the pressure exerted on the mouthpiece. In addition the responsiveness can be varied by altering the materials, or their thickness. For example the upward force on the valve portion exerted by the web portion can be decreased by thinning the web portion or by forming a web portion of a less resilient material. As a result a fully responsive system is provided which can be adapted to change with the infant's changing needs.

Figure 5A:
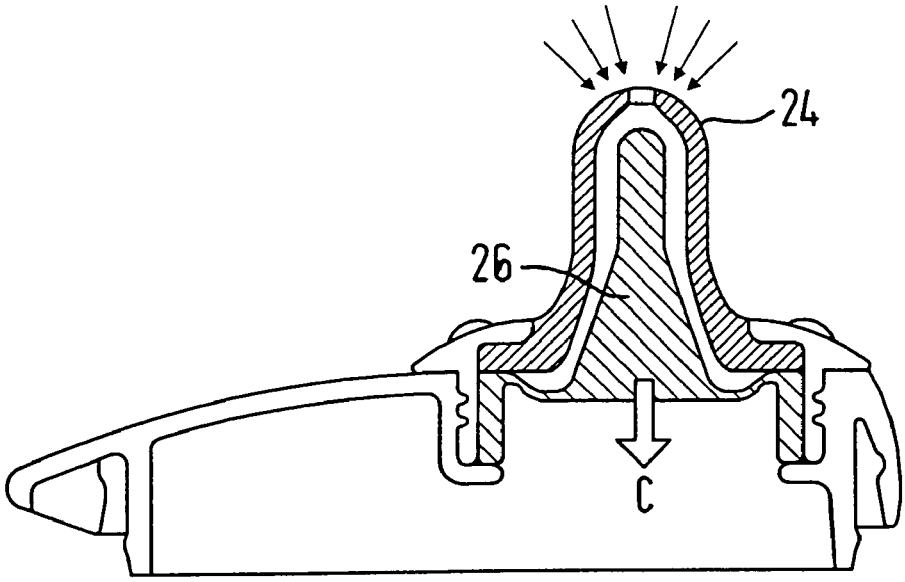
FIG. 5*a* is a side cross-sectional view of the valve in a venting position.
Figure 5B:
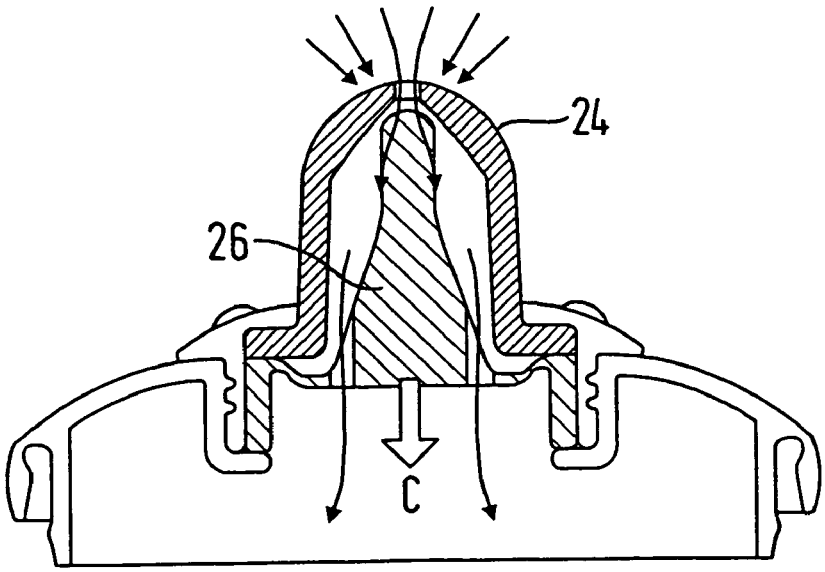
FIG. 5*b* is a front cross-sectional view of the valve in a venting position.

Referring to FIGS. 5*a* and 5*b*, it can be seen that the arrangement according to the invention further provides automatic venting action after drinking has taken place. As liquid is removed from the cup a partial vacuum will build up inside the cup which, if not alleviated, would restrict and eventually stop the flow of liquid from the valve. However as a result of the flexibility of the web 64 of the valve element 26, as negative pressure builds up inside the cup a downward force denoted by arrow C is exerted on the valve element 26. This draws the valve element down, opening the orifice 44 in the mouthpiece 24 and allowing air to enter the cup to equalise the pressure. As a result the invention provides automatic pressure equalisation of additional venting elements. This is achieved at least in part by ensuring that the web 64 (or other resilient member in alternative embodiments) is of greater flexibility/lesser resilience than the flexible mouthpiece, such that it displaces further under the same force. This also ensures that the valve will not open under suction.

It will be appreciated that the specific configuration described with reference to FIGS. 2 to 5 comprises only one embodiment of the invention; various other ways of forming the invention are discussed below. To avoid repetition, like reference numerals denote like elements throughout the figures and explanation will only be duplicated where appropriate.

Figure 6:
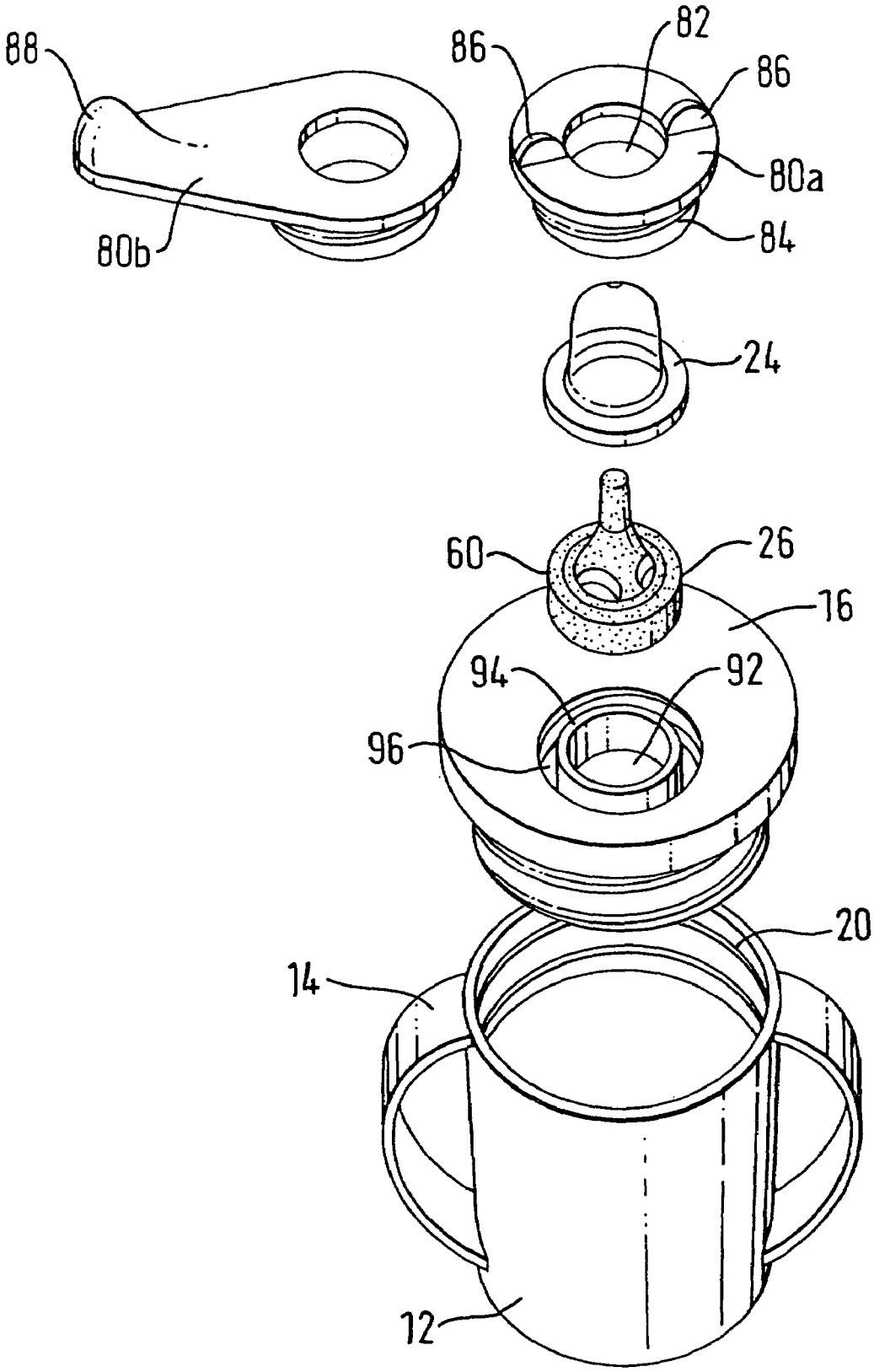
FIG. 6 shows an alternative construction for a drinking vessel according to the present invention.

Referring to FIG. 6 a mounting arrangement similar to that shown in FIGS. 2 to 5 is shown. The cover 16 includes a mouthpiece aperture 92 having a cylindrical wall 94 around it and an annular blind aperture 96 around the cylindrical wall 94. Although the wall is shown as being of the same height as the top surface of the cover it may be of reduced height or comprise an annular groove, all serving to locate the elements. Alternatively the wall may be dispensed with. The cylindrical mounting portion 60 of the valve element 26 is received in the annular aperture 96 and the mouthpiece 24 fits over the valve element 26 as shown in, for example, FIG. 3*a*. A collar 80*a* fits over the mouthpiece 24 and valve element 26 and includes an aperture 82 through which the mouthpiece 24 extends. The collar has a cylindrical skirt 84 which is threaded to screw into a corresponding threaded portion of annular aperture 96 so as to hold the mouthpiece 24 and valve element 26 firmly in place. The collar 80*a* includes finger lugs 86 allowing it to be screwed and unscrewed more easily. The collar 80*a* can be replaced by an alternative collar 80*b* which includes a lobe 88 extending generally radially providing a mechanical advantage for screwing and unscrewing the collar.

Figure 7:
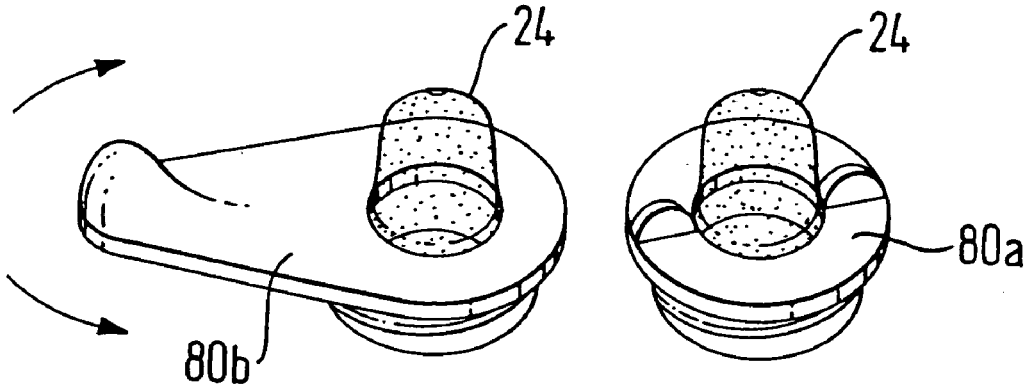
FIG. 7 shows a further alternative construction for a drinking vessel according to the present invention.
Figure 7:
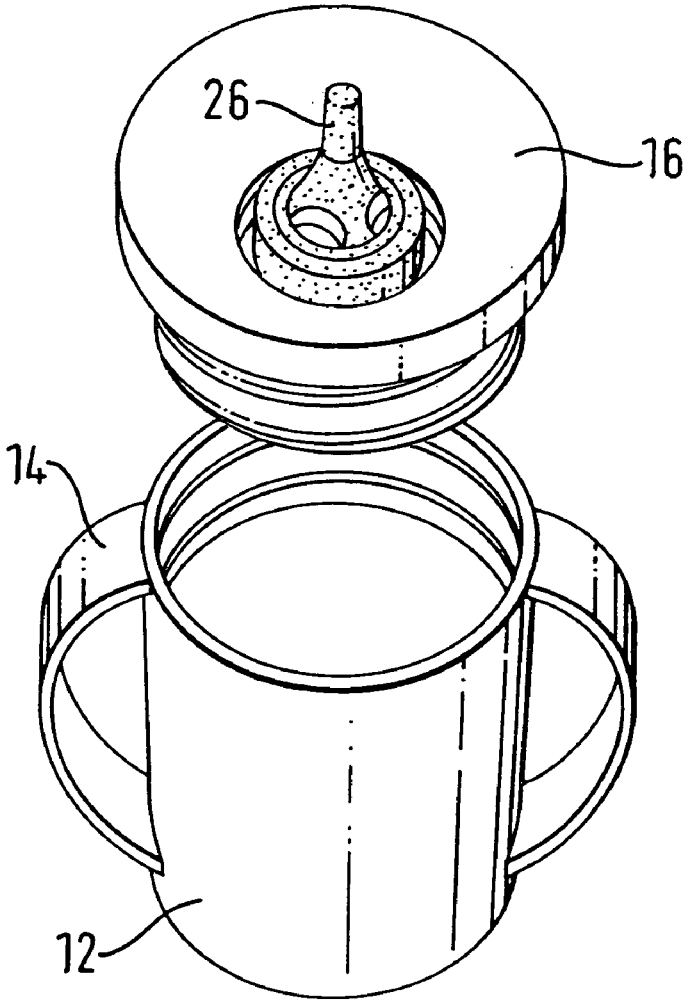

The arrangement of FIG. 7 is similar to that of FIG. 6 except that the valve element 26 is integrally moulded with the cover 16 and the mouthpiece 24 is integrally moulded with the collar 80*a* or 80*b*. In each case the components can be two-shot moulded in view of the different material requirements for the various elements.

Figure 8:
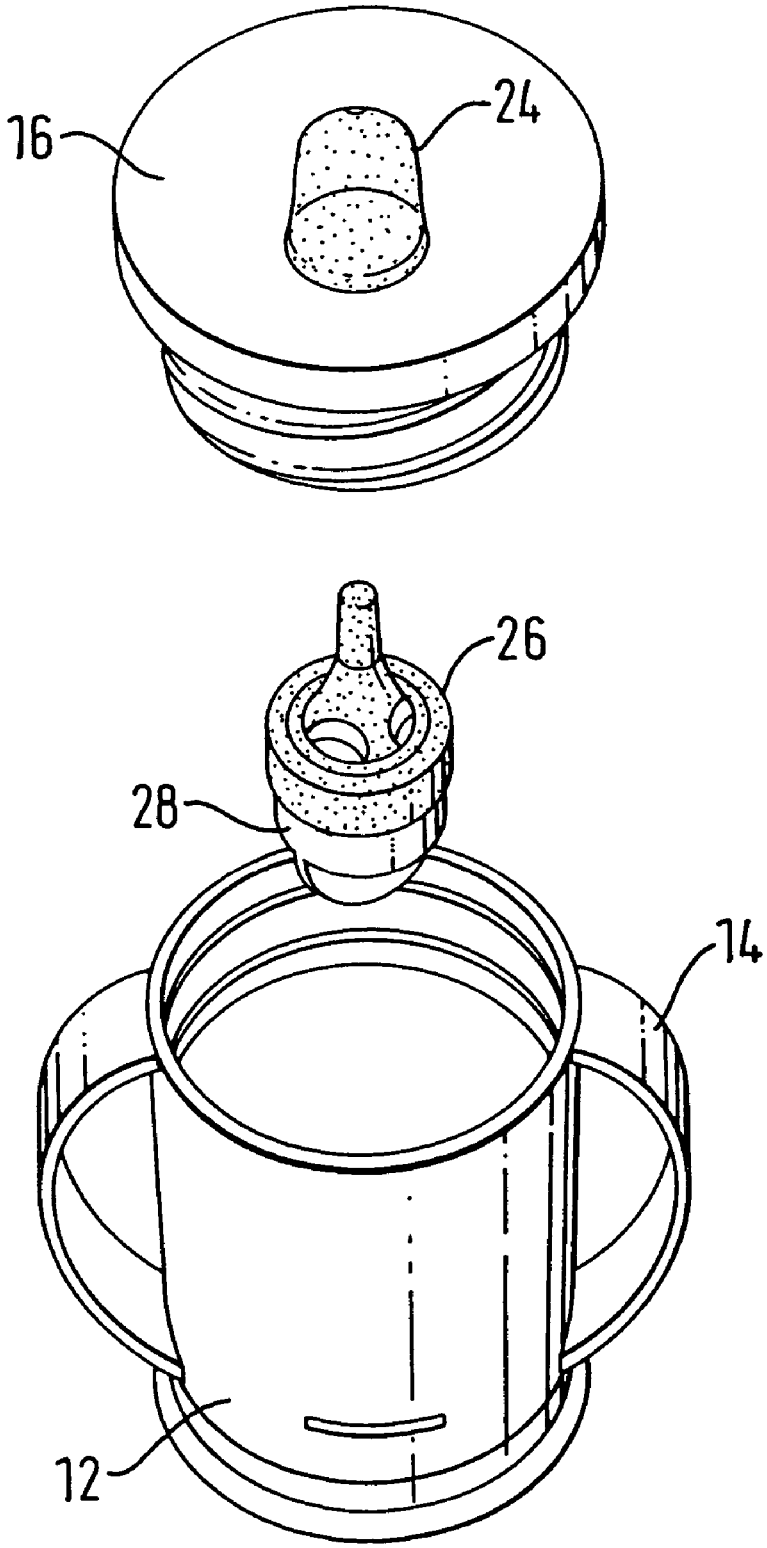
FIG. 8 shows a further alternative construction for a drinking vessel according to the present invention.

The arrangement of FIG. 8 is similar to that of FIG. 1 except that the valve element 26 is formed integrally with the collar 28 and the mouthpiece 24 is formed integrally with the cover 16, the components again being two-shot moulded as appropriate.

It will be seen that the various configurations all provide numerous common advantages. The material from which the various parts are formed and in particular the mouthpiece and valve element components can be changed to increase or decrease their hardness and/or elastic qualities. Indeed the valve member can be two-shot moulded allowing a variation of flexibility between, for example, the web and mounting portion and the valve portion. In addition an effectively modular system is provided such that single elements can be replaced or interchanged to best fit the child's needs. The various components are easily separated for cleaning, provide no dirt traps and are indeed easily cleaned. The components are of a size and shape that remove any choking hazard and again makes cleaning more easy—for example the valve element comprises a single integral piece. It will be appreciated that the various materials discussed above different components can be changed or altered as long as the relevant functional requirements are met but preferably the selected materials ensure that operation of the valve is not affected by the range of temperatures to which the cup may be subjected or to sudden changes in temperature experienced in cleaning, use and/or storage of the cup.

Various alternative valve arrangements can be provided according to the present invention as discussed below.

Figure 9:
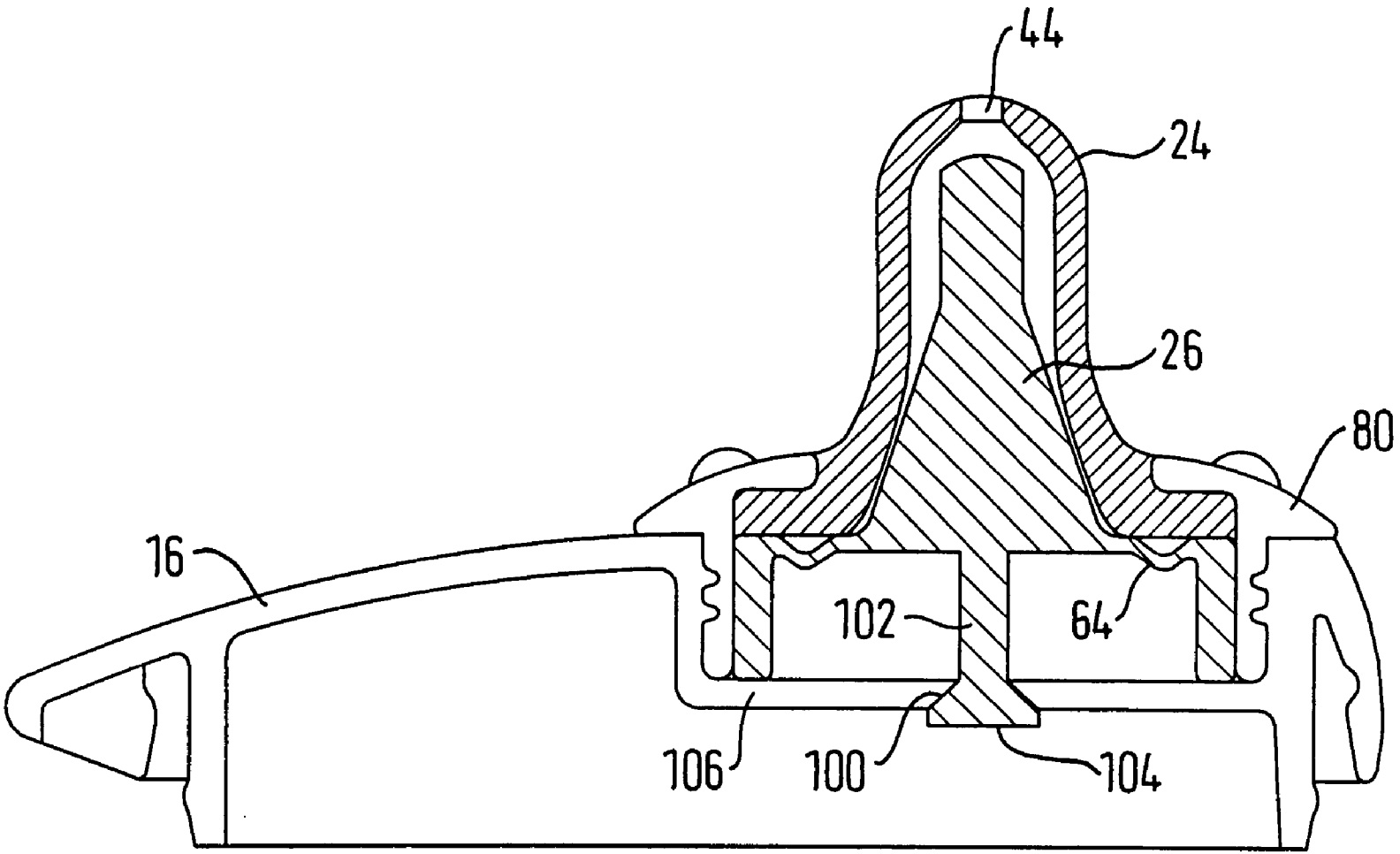
FIG. 9 is a cross-sectional view of an alternative valve configuration according to the present invention.

FIG. 9 shows a variant on the arrangement shown in FIGS. 2 to 5 in which the valve element seals against a liquid flow aperture 100 in the cup cover rather than on the mouthpiece 24. In particular the valve element includes a downwardly depending post 102 terminating in a flared stop 104. The mouthpiece 24 and valve element are screwed into place on the cover 16 by collar 80 as discussed in relation to FIGS. 2 to 5, but the opening in the cover includes a base wall 106 having said central orifice 100 which tapers from a narrow circular upper end to a wider circular lower end. The plug 104 on the valve element 26 engages the orifice 100 from the underside such that the upward bias provided by the web 64 urges the plug 104 to close the orifice 100.

As pressure is applied to the sides of the mouthpiece 24 the valve element 26 is pushed downwardly to open aperture 100, and when the latter force is removed the plug 104 will spring back to close the aperture 100. In addition the system will continue to automatically vent allowing pressure equalisation. As shown, the valve element 26 therefore does not need to engage the orifice 44 in the mouthpiece 24 although this engagement can also be provided for redundancy. Alternatively, however, the valve element can terminate at the end of the frusto-conical portion and indeed need not even be solid here as long as it provides an appropriate tapering surface to cooperate with the inside of the mouthpiece 24. In addition the flared plug 104 could flare out less radically than shown to assist in assembly/manufacture of the system.

Figure 10A:
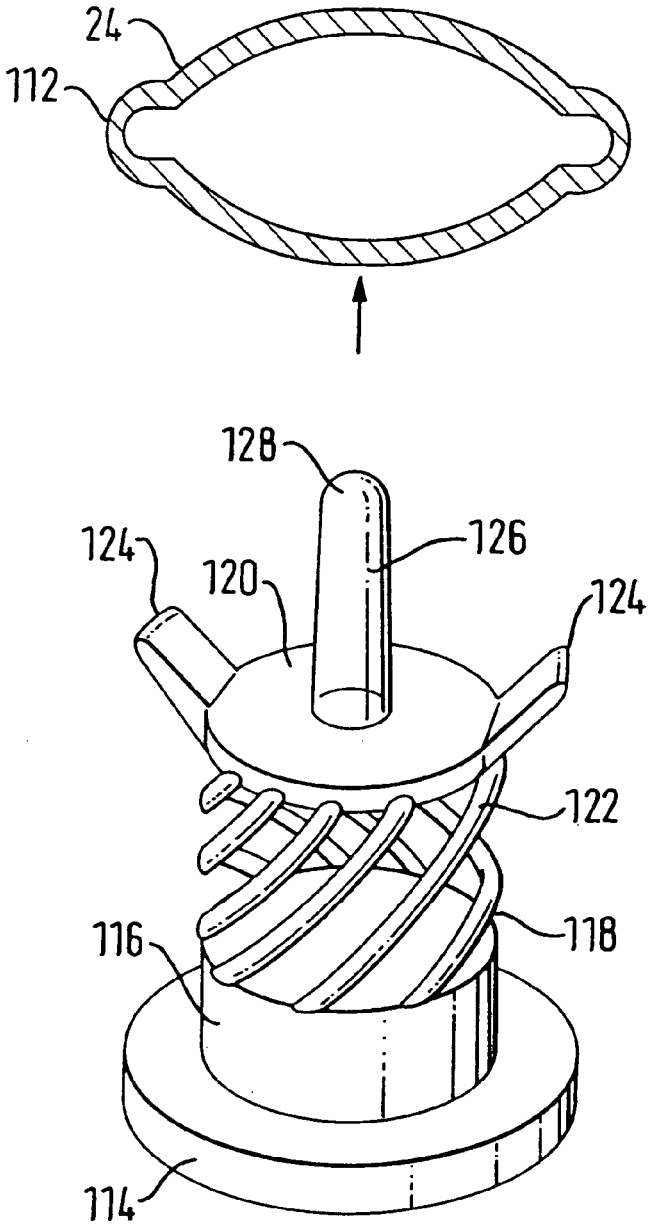
FIG. 10*a* is a perspective view of an alternative valve element according to the present invention.

Referring to FIG. 10 the mouthpiece 24 is substantially as discussed above except for the provision of internal shoulders 110 providing a stepped, reduced internal diameter at the upper end of the mouthpiece. In addition the shorter walls of the mouthpiece 24 may be of reduced diameter or have a reduced diameter portion 112 allowing improved lateral compression of the mouthpiece in an area where additional hardness is not required to compensate for tooth pressure by the infant.

The valve element 26 includes a base flange 114 from which extends a generally hollow cylindrical portion 116 communicating with a hole through the base flange 114 (not shown) to provide a flow path. The cylindrical portion 116 includes a resilient portion 118 urging an upper disc face 120 upwardly. The resilient portion 118 includes a plurality of resilient limbs 122 on which the disc 120 is supported. Each of the limbs 122 generally forms the shape of a segment of a helix although any other appropriate resilient configuration can be adopted.

Figure 10B:
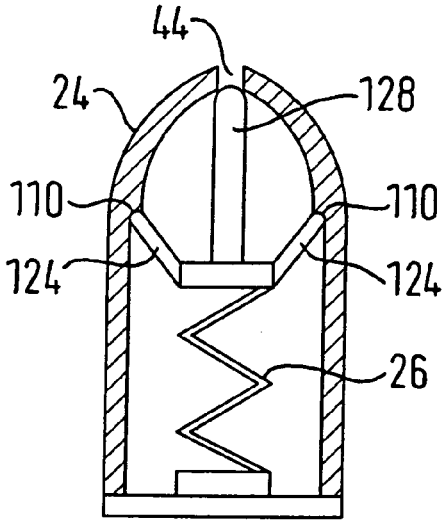
FIG. 10*b* is a cross-sectional view of the valve element of FIG. 10*a* in a mouthpiece in a closed position.
Figure 10C:
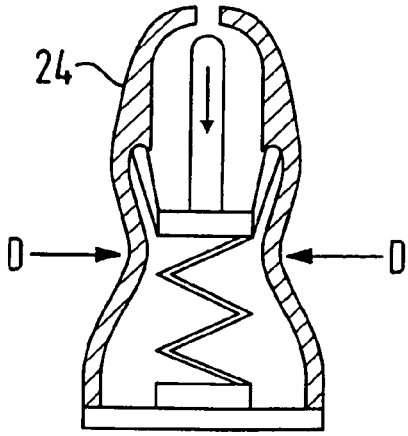
FIG. 10*c* is a cross-sectional view of the valve element of FIG. 10*a* in a mouthpiece in an open configuration.

The disc 120 carries ears 124 extending laterally and diagonally upwards therefrom as well as a central post 126 having an upper valve end 128. As shown in FIG. 10*b*, when the valve element 26 is positioned within the mouthpiece 24 in its relaxed position the valve face 128 engages orifice 44 in the mouthpiece. The ears 124 engage the underside of the shoulder 110. When lateral pressure is applied to the mouthpiece 24 as denoted by arrows D in FIG. 10*c* the upper ends of the ears 124 are forced generally inwardly urging the valve disc 120 downwardly to open orifice 44 after which liquid can flow through the hollow cylindrical portion 116 of the valve. Again because of the resilience of the limbs 122 the valve will automatically close when the mouthpiece relaxes but will allow self-venting.

Figure 11A:
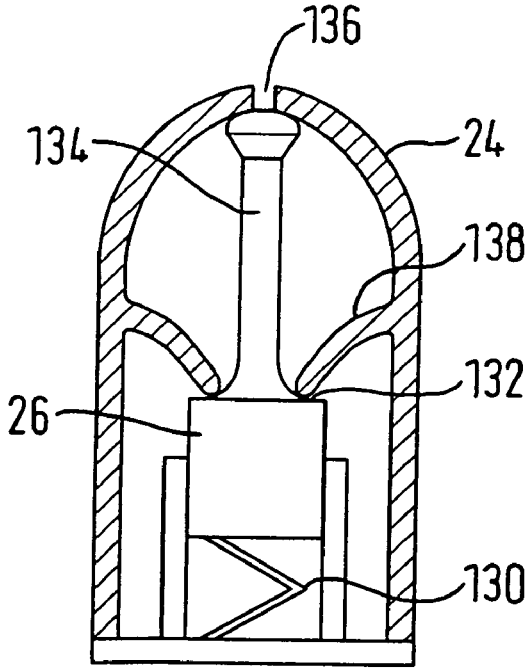
FIG. 11*a* is a cross-sectional view of a further valve element configuration in a mouthpiece in a closed position.
Figure 11B:
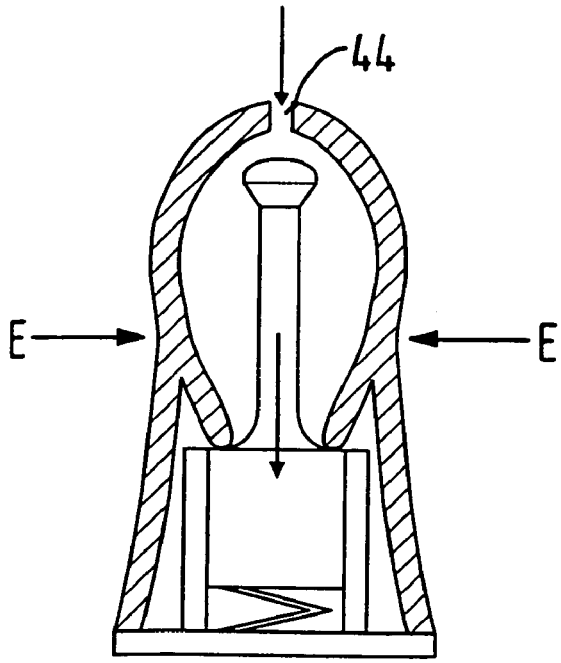
FIG. 11*b* is a cross-sectional view of the valve configuration of FIG. 11*a* in an open configuration.
Figure 11C:
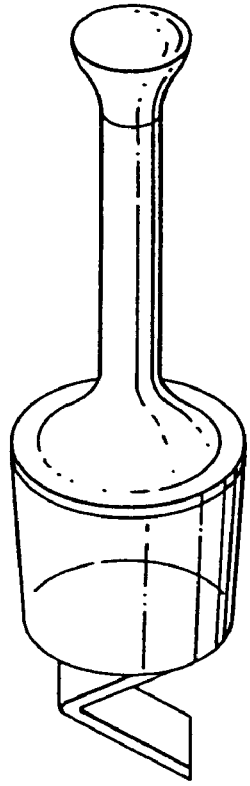
FIG. 11*c* is a perspective view of a valve element of FIGS. 11*a* and 11*b;*
Figure 12:
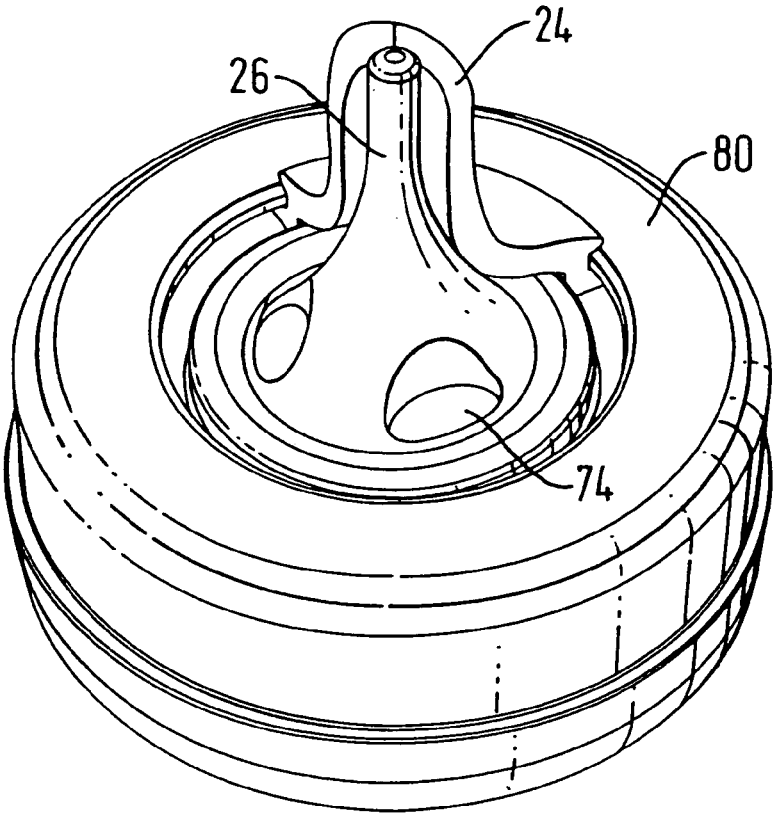
FIG. 12 is a partially cut away perspective view of the arrangement shown in FIGS. 3 to 5.

The arrangement shown in FIG. 11 is similar to that shown in FIG. 10 except that the valve element includes a simple spring 130 at its lower end and upwardly facing shoulders 132 from which a post 134 extends carrying a valve face 136. The mouthpiece itself includes inwardly facing ears 138 which are directed generally diagonally downwards into engagement with the valve shoulders 132. When lateral pressure is applied to the mouthpiece as denoted by arrows E in FIG. 11*b* the ears 138 urge the valve member downwardly, opening the orifice 44, again providing a self-venting arrangement.

Figure 13A:
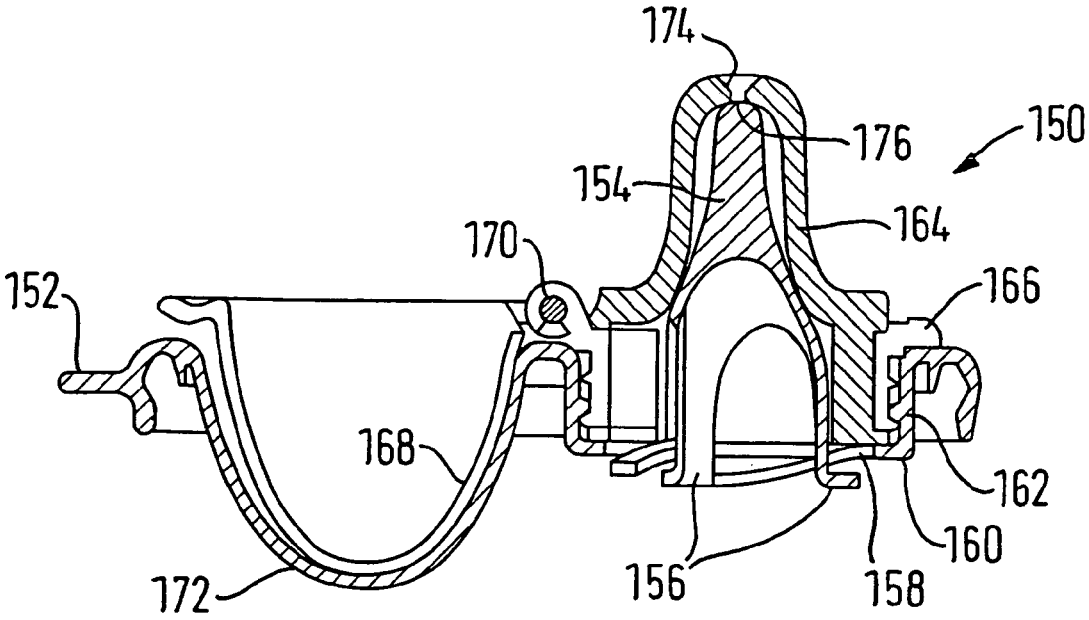
FIG. 13*a* is a sectional view of an alternative cover/mouthpiece configuration.
Figure 13B:
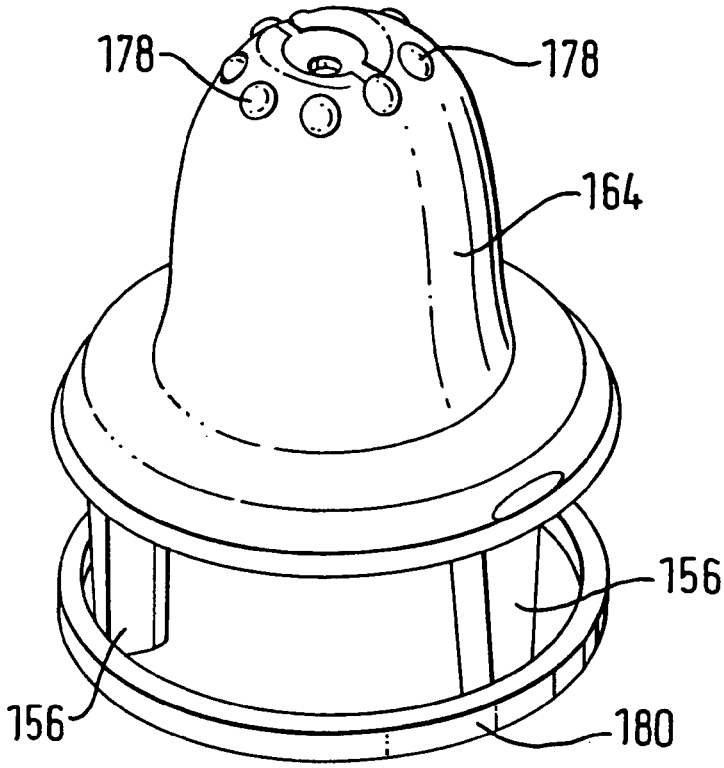
FIG. 13*b* is a perspective view of the mouthpiece shown in FIG. 13*a;*
Figure 13C:
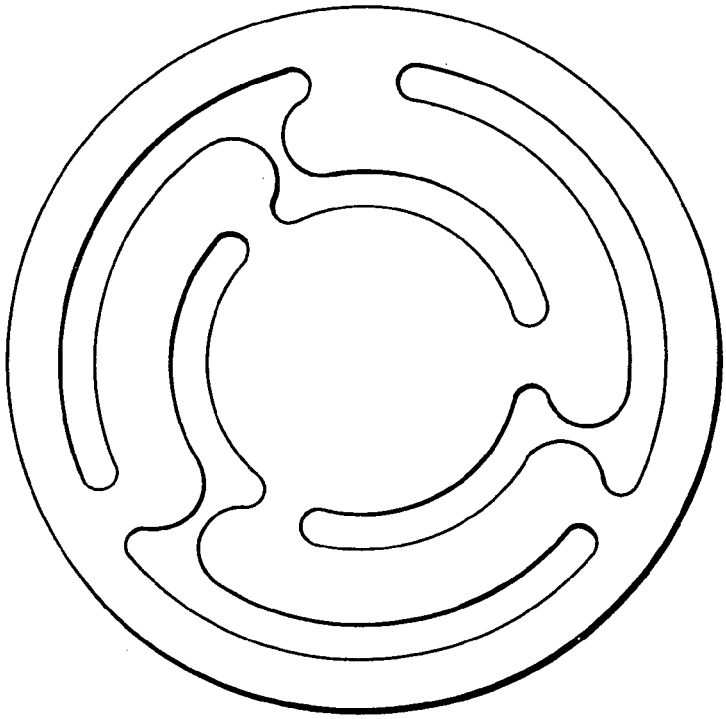
FIG. 13*c* is a plan view of the valve element shown in FIG. 13*a.*

An alternative cover/mouthpiece arrangement is shown in FIGS. 13*a* to 13*c*. The operation of the arrangement is the same as described with regards to FIGS. 1 to 5 but some constructional details vary. Referring firstly to FIG. 13*a*, the cover is designated generally 150 and is a resilient push-fit onto the cup body (not shown). A tab 152 is provided on the circumference of the cover to facilitate ease of cover removal. The valve element 154 is of similar shape to the elements described in previous embodiments except that the taper is curved rather than straight-edged. The valve element is of a resilient material such as PP or PP/TPE blend. The valve element 154 includes three integral legs 156 extending generally downwardly from its lower end (see also FIG. 13*b*) although any appropriate number of legs can be used. The valve element is moulded as part of the cover and each leg 156 includes a horizontal extension 158 extending tangentially to a ring-shaped mounting flange 160 of larger diameter on the cover as shown in FIG. 13*c*. This provides the resilience and upward bias allowing the valve element to operate.

The mouthpiece is a screw fit into a recess 162 above the flange 160 in the cover 150. The mouthpiece includes a mouthpiece part 164 integral with a locking ring (carrying the screw thread) 164 in a one-piece two-shot moulded component where the teat is formed of a TPE material and the locking is moulded from PP. A separate hygiene cover 168 is hinged at 170 to the locking ring 166 allowing it to hinge over the mouthpiece 164. It is arranged to clip into place on the locking ring to protect the mouthpiece. A recess 172 receives the hygiene cover 168 when it is hinged open.

The locking ring preferably includes an indicator mark to match up with an indicator mark on the cover itself to ensure that the hygiene cover will always be positioned correctly when the mouthpiece is screwed into place. In addition, the resilient material of the mouthpiece part 164 preferably extends down the inside of the locking ring 166 and has a lower flange 180 projecting around the base of the locking ring 166 which can be seen at the cover portion of FIG. 13*b*. As a result, when the mouthpiece is screwed into place, the locking ring squeezes the resilient material flange against the cover flange 160 to provide a liquid-tight seal.

Referring to both FIGS. 13*a* and 13*b*, it will be seen that the mouthpiece 164 is of appropriately thick material to improve the durability of the sealing action and bite resistance of the teat. In particular at the top of the mouthpiece there is provided a recessed, reduced thickness portion 174 surrounding the central outlet orifice 176. The reduced thickness portion forms a membrane sitting below the teat top surface as a result of which the effective sealing area is protected from direct biting. The membrane 174 accommodates variations in the final rest position of the tip of the valve element 154, improving the seal. As can be seen in FIG. 13*b* a pattern of small raised domes 178 is provided around the top of the mouthpiece to further improve the bite resistance of the teat.

It will be appreciated that various aspects of one or other embodiment can be incorporated with any other embodiment as appropriate and as will be clearly and unambiguously derivable to the skilled person. Although the system is discussed specifically in relation to infant drinking vessels, it may be used equally in other appropriate drinking vessels where a valved action is required, for example adult or sports drinking bottles. The vessels may be of the multi-use kind or single use, disposable vessels. The materials specified are exemplary and the skilled person will recognise alternative suitable materials for the various functions specified.

The invention claimed is:

1. A drinking vessel comprising a vessel body, a cover including a flexible mouthpiece defining a flow passage from the vessel body and a valve element slideably moveable relative to the mouthpiece in flow passage opening and closing directions, in which the mouthpiece and valve element have cooperating formations comprising mating surfaces in a taper fit arranged such that, in a flexed condition when a force is applied to the mouthpiece, the mating surfaces in the taper fit move the valve element in the flow passage opening direction, and in which the valve element is biased in the closing direction in a relaxed condition.

2. A vessel as claimed in claim 1 in which the mouthpiece has a top, including a drinking orifice, and sides, the mouthpiece being arranged such that, to obtain a flexed condition, a force is applied to the sides of the mouthpiece.

3. A vessel as claimed in claim 2 in which the valve element closes the drinking orifice in the relaxed condition.

4. A vessel as claimed in claim 2 in which the drinking orifice is provided in a recessed portion of the mouthpiece top.

5. A vessel as claimed in claim 2 in which the drinking orifice is provided in a membrane-like portion of the mouthpiece top.

6. A vessel as claimed in claim 2 in which the valve element closes an aperture spaced from the drinking orifice in the relaxed condition.

7. A vessel as claimed in claim 1 in which the mouthpiece and valve elements are individual, separable components.

8. A vessel as claimed in claim 1 in which the valve element includes a mounting portion and a valve portion and the valve element is biased in the closing direction by a resilient web connecting the mounting portion and the valve portion.

9. A vessel as claimed in claim 8 in which any of the resilient web or portions is of lesser resilience than the flexible mouthpiece.

10. A vessel as claimed in claim 8 in which the web comprises a plurality resilient limbs.

11. A vessel as claimed in claim 1 in which the valve element includes a valve portion and a resilient portion biasing the valve portion in the closing direction.

12. A vessel as claimed in claim 1 in which the mouthpiece includes a drinking orifice and the valve element closes the drinking orifice in the relaxed condition and in which the mating surfaces of the mouthpiece and valve element are located in the vicinity of the drinking orifice.

13. A vessel as claimed in claim 1 in which the mouthpiece includes a base mounted at the cover, the valve element is provided within the mouthpiece and the cooperating formations are provided in the vicinity of the mouthpiece base.

14. A vessel as claimed in claim 1 comprising an infant drinking vessel.

15. A vessel as claimed in claim 1 which the valve element is formed integrally with the vessel cover.

16. A vessel as claimed in claim 15 in which the mouthpiece is removably attached to the vessel cover.

17. A valve element for a drinking vessel including a mounting portion and a valve portion connected by a web defining flow apertures, in which the valve portion is resiliently biased away from the mounting portion by the web, and includes a valve face and a tapered drive face, said tapered drive face being arranged to cooperate with a mating surface of a mouthpiece of the drinking vessel so that, when a force is applied to the mouthpiece, the resilient bias is overcome.

18. A valve element as claimed in claim 17 in which the valve element is formed of flexible resilient material.

* * * * *